US005085281A

United States Patent [19]

Selly

[11] Patent Number: 5,085,281

[45] Date of Patent: Feb. 4, 1992

[54] SLIDE HAMMER APPARATUS

[76] Inventor: Patrick H. Selly, 805 SW. 3rd Ave., Faribault, Minn. 55021

[21] Appl. No.: 591,945

[22] Filed: Oct. 2, 1990

[51] Int. Cl.[5] ..... B25D 1/16

[52] U.S. Cl. ..... 173/91; 173/128; 173/132; 405/244

[58] Field of Search ..... 173/91, 30, 132, 122, 173/124, 128, 130; 405/244; 52/154, 165

[56] References Cited

U.S. PATENT DOCUMENTS

| | | | |
|---|---|---|---|
| 1,311,335 | 7/1919 | Foulke | 405/244 |
| 1,569,857 | 1/1926 | Farb | 405/244 |
| 2,067,890 | 1/1937 | Collard | 405/244 |
| 2,525,316 | 10/1950 | Schiff | 173/91 |
| 3,381,763 | 5/1968 | Matson | 173/91 |
| 4,252,472 | 2/1981 | Moraly | 173/126 X |
| 4,261,424 | 4/1981 | Gonterman et al. | 173/91 |
| 4,544,040 | 10/1985 | Sweeney | 173/91 |
| 4,557,409 | 12/1985 | Hecock et al. | 173/91 X |
| 4,644,713 | 2/1987 | Lehman | 52/165 |
| 4,971,479 | 11/1990 | Byers, Sr. et al. | 173/130 X |

*Primary Examiner*—Frank T. Yost
*Assistant Examiner*—Rinaldi Rada
*Attorney, Agent, or Firm*—Clayton R. Johnson

[57] ABSTRACT

A conventional stake member having an annular post mount joined to the upper end of the stake to form a socket for receiving the lower end portion of a right angular extension of the elongated mounting member of a slide hammer. A right angle hammer member has a lower terminal edge for forming a mating fit with the top edge of the stake when the extension extends into the socket and a pin removable attaches the stake to the hammer member and extension. The upper end portion of the rod which forms part of the mounting member mounts an anvil having a top surface and a bottom surface to be selectively struck by a slide member for the selective one of pulling the stake and driving the stake into the ground, the slide member being reciprocal relative to the mounting member. The anvil is located within the slide member. The lower end portion of the rod is welded to the apex of the extension.

13 Claims, 2 Drawing Sheets

SLIDE HAMMER APPARATUS

BACKGROUND OF THE INVENTION

The invention relates to a slide hammer for driving stakes, for example of the type for supporting posts of real estate signs, in the ground and removing such stakes.

U.S. Pat. No. 4,261,424 to Gonterman discloses s slide hammer for driving a right angle stake into the ground and alternately removing the stake. The mounting tube has strike plates intermediate its opposite ends against which the slide tube strike plates will hit for transmitting a hammering force to the mounting tube The lower end of the mounting tube has slots that are abuttable against slot edges of the stake for transmitting the hammering force from the mounting tube to the stake, one of the plates being struck when removing the plate and the other when driving a stake. The mounting tube is rotated relative to the stake to provide an interlocking arrangement between them when a stake is to be driven into or pulled out of the ground. In use, the edge portions of the stake and mounting tube abut against one another (only a relatively small part of the horizontal edge portions of one strike horizontal edge portions of the other).

U.S Pat. No. 2,525,316 to Schiff discloses a post driver and ejector having axially spaced anvils mounted in fixed relationship to the mounting tube, and upper and lower hammer members mounted at opposite ends of a slide tube. A drive pin is extended through apertures in the anvil, the mounting tube and the tubular post that is extended into the lower end of the mounting tube. The driving force is transmitted from the slide hammer to the post through the pin.

In Moraly, U.S. Pat. No. 4,252,472, two plates are joined together to be generally W-shape in transverse cross section and have a lower pointed end and a top horizontal edge. The slide hammer mounting tube mounts a slide tube for striking a ring that is fixed to the mounting tube. The ring delivers the hammering blows to the L-shaped member on diametric opposite sides of the mounting tube, the dimension of the W-shaped member to which the striking blows are applied being much greater than the thickness of the W-shaped member, but substantially less than the total horizontal dimension thereof.

In order to provide improved apparatus for driving and removing a stake, and in particular to avoid having to manually hold the stake while minimizing damage to the struck edge of the stake, this invention has been made.

SUMMARY OF THE INVENTION

The slide hammer includes an axially elongated mounting member that mounts a slide member for reciprocal movement relative thereto for delivering hammering blows to an anvil on the mounting member. The lower end of the mounting member mounts a striking member for abutting against the upper horizontal edge portion of a stake member or post mount through an elongated dimensions that is many times greater than the thickness thereof. A guide member joined to the mounting member is removably extended into an open top annular member portion of the stake member.

One of the objects of this invention is to provide new and novel slide hammer means for driving a stake member into the ground. In furtherance of the last mentioned object of this invention it is an object to provide new and novel means for driving a stake member of the type that has a top horizontally extending edge that is of a relative thin thickness, particularly in comparison to the horizontal dimension that extends generally at right angles to the thickness dimension. Another object of this invention is to provide new and novel slide means of a construction for minimizing injury while driving or removing a stake member.

BRIEF DESCRIPTION OF THE DRAWINGS

Referring to FIG. 2, the slide hammer includes a vertically reciprocal slide member that includes an axially (longitudinally) elongated slide tube 11 having a cap 10 welded to the tube upper end, an intermediate tube 13 welded to the lower end of the slide tube to extend both above and below the lower end of the slide tube, and a pulling (inner) tube 14 that has its lower end welded to the lower end of the intermediate tube. The pulling tube which has its upper end at an elevation axially intermediate the upper and lower ends of the intermediate tube extends within the intermediate tube. The upper end portion of the intermediate tube extends within the slide tube. The pulling tube serves as a guide tube.

Figure 1:
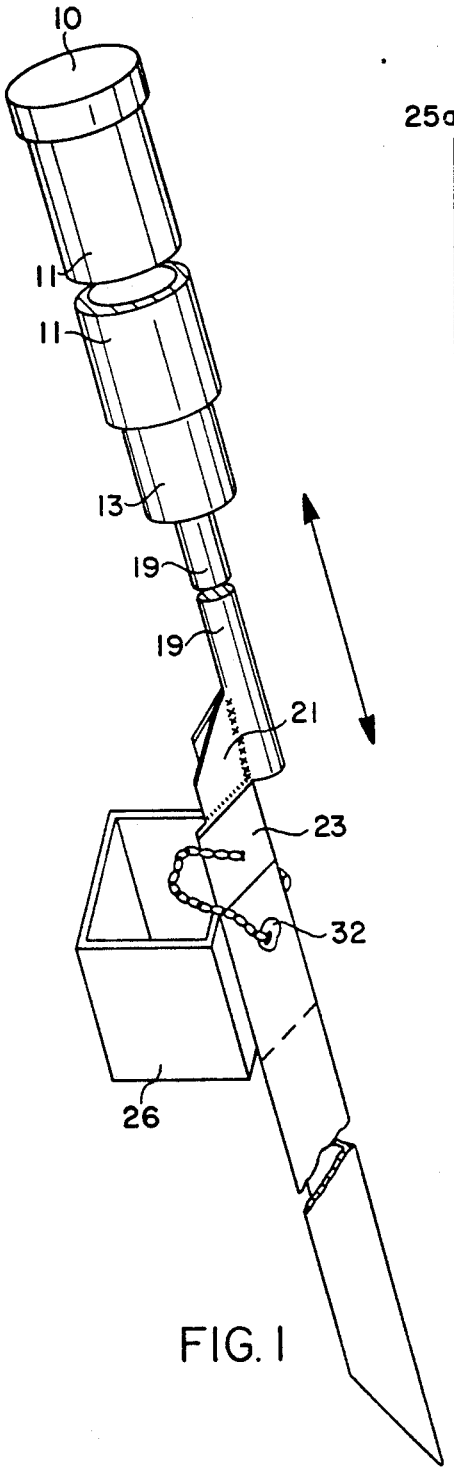
FIG. 1 is a perspective view of the slide hammer of this invention attached to a stake member in manner for driving or removing the stake member, vertical intermediate parts being broken away.

A cylindrical anvil 12 is located within the slide tube such that the slide member is axially movable between a position that the cap delivers a hammering blow to the top surface of the anvil and a position that the inner tube abuts against the undersurface of the anvil to deliver a pulling hammering blow to the anvil. The anvil is welded to the upper end of the mounting member 19-21 which includes an axially (longitudinally) elongated mounting rod 19 that extends through the pulling tube, the inner tube being axially and rotatable relative to the rod.

The mounting member also includes a right angle mounting (hammer) extension 20, 21 (legs 20, 21) that has its upper apex end portion welded at 17 to the lower end portion of the mounting rod such that the rod is located opposite the included right angle. Each of the legs 20, 21 is generally planar. The mounting rod is of a length that when the cap 10 is in abutting relationship to the anvil, the lower edges of both of the pulling tube 14 and intermediate tube are vertically above the uppermost edge portions of the extension.

A hammer member has a pair of hammer plates 22, 23 welded together to extend at right angles to one another and to the adjacent parts of the hammer extension leg 20 and the lower end of the mounting rod. The included right angle of the hammer member opens in the same direction as the extension. Each of the hammer plates is welded at 18 to the adjacent leg 20, 21 and extends transversely outwardly of the leg to which it is welded by a thickness of the plate while the width of each of the hammer plates is slightly greater than the corresponding width W of the extension leg to which it is welded.

The hammer extension extends above the hammer plates, and a substantial distance below the hammer plates. Desirably the lower transverse edges of the plates 22, 23 which form the lowermost terminal portion of the plates advantageously are coplanar. Apertures 27 ar provided in the lower parts of the légs 20, 21 in alignment with one another at a lower elevation than the plates 22, 23. One end of a Chain 31 is welded to the hammer plate 23 while the opposite end mounts a pin 32 that is extendable through both of the apertures 27, there being provided a cotter member 33.

Figure 4:
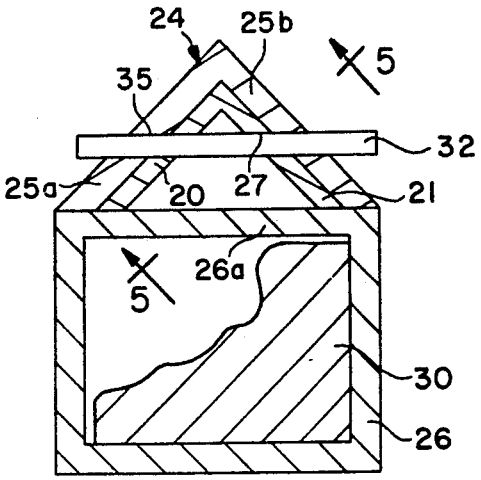
FIG. 4 is a transverse cross section view of the stake member and the slide hammer in the condition shown in FIG. 1, said view being taken along the line and in the direction of the arrows 4—4 of FIG. 3.
Figure 5:
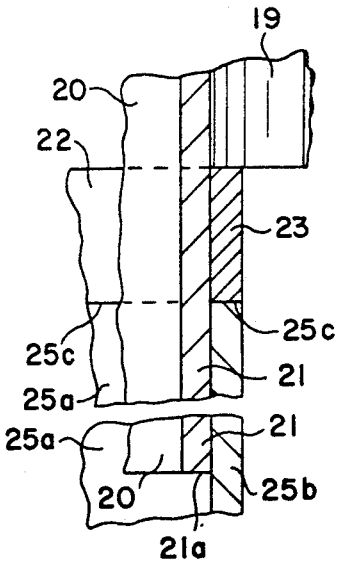
FIG. 5 is a fragmentary vertical cross sectional view that is generally take along the lines and in the direction of the arrows 5—5 of FIG. 4.
Figure 3:
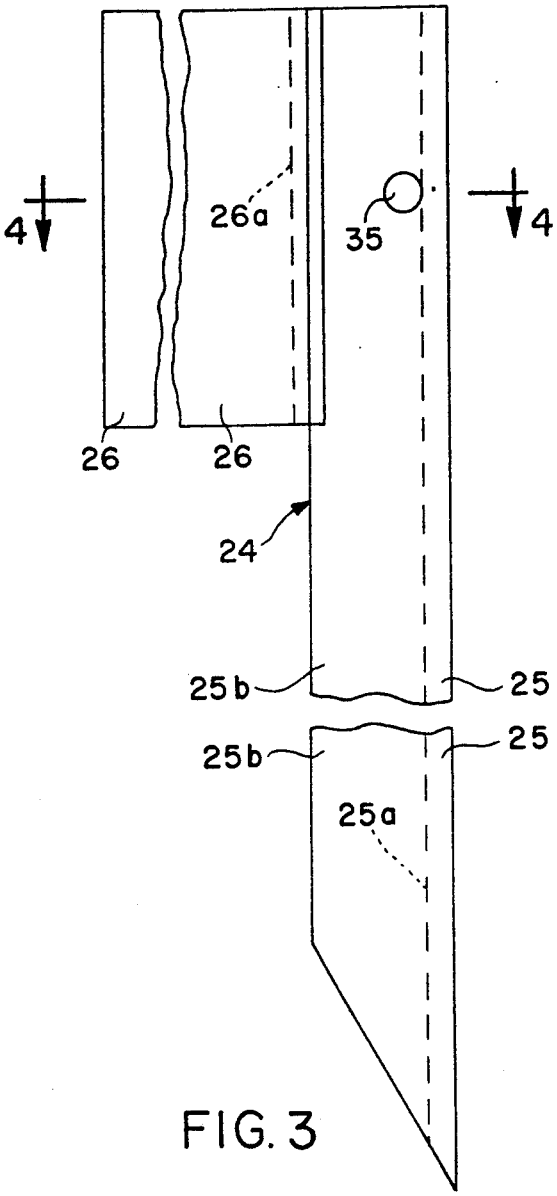
FIG. 3 is a side view of the stake member with a vertical and a horizontal intermediate part broken away.
Figure 2:
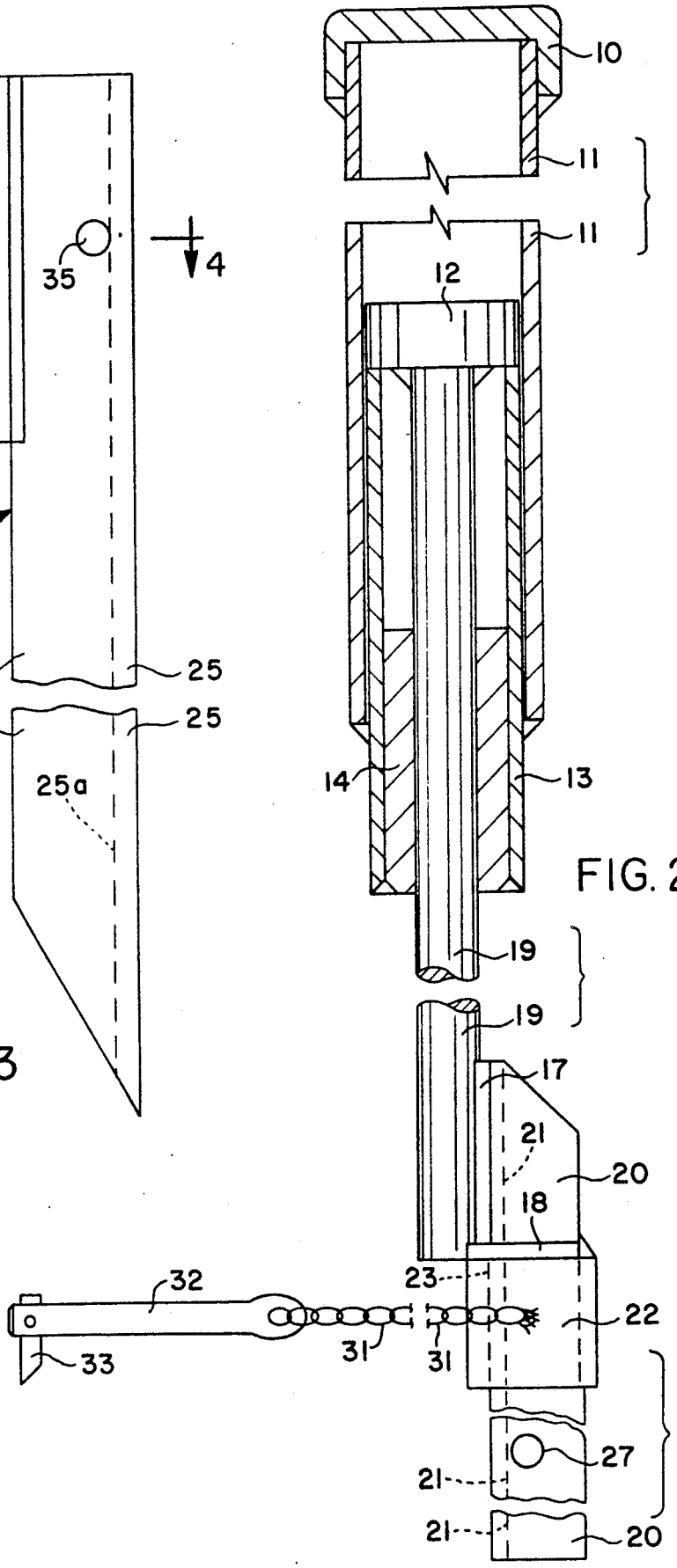
FIG. 2 is in part a vertical cross sectional view and in part a side view of the slide hammer with various vertical intermediate parts broken away.

A conventional stake member, generally designated 24, includes a longitudinally elongated right angle stake 25 having a lower pointed edge portion, and an annular post mount 26, for example rectangular in transverse cross section, that has opposite vertical edge portions of one side **26*a* of the mount welded to the respective free terminal upper vertical edge portions of the stake legs 25*a*, 25*b*. As a result the post mount opens both upwardly and downwardly as does the generally triangular space bounded (socket defined) by the mount side 26*a* and the stake legs. Advantageously the stake legs are of the same transverse dimensions; and the extension legs are of the same transverse dimensions and are of widths such that when the extension is inserted into the said triangular space (socket), the extension apex is closely adjacent to the stake apex, and the vertical free terminal upper edge portions of the stake are closely adjacent to the side 26*a* as shown in FIG. 4** to limit wobbling of the stake member relative to the slide hammer during use.

Aligned apertures 35 are provided in the stake legs to have the pin 32 extended therethrough when the pin is extended through the apertures 27 of the hammer extension with the hammer extension extended into the above mentioned stake member socket. At the time the pin 32 extends through the apertures in the stake and extension, the hammer plates 22, 23 have their lower edges closely adjacent to the upper edges of the stake legs and substantially vertically aligned therewith for transmitting a hammering blow to the stake legs when the cap is dropped or moved downwardly to strike the anvil Desirably the top edges of the stake and the bottom transverse edges of the hammer plates when the pin is extended through the apertures 27, 35 substantially form a mating fit and preferably are transversely coplanar. Also it is advantageous to have the top edges of the post mount substantially coplanar with the top edges of the stake 24.

Advantageously the extension is of a length to have its lower edge **21*a*** located transversely adjacent to the lower transverse edge of the mount. As a result the extension does not have to be pounded into the ground if the mount is to have its lower edge at ground level while at the same time it is of a height for minimizing the chance of any wobbling movement of the slide hammer relative to the stake mount.

When the slide hammer extension is extended in the stake socket and secured to the stake by the pin 32 as has been referred to above, the slide hammer is ready for use to pull a stake from the ground or pound the stake into the ground, depending upon the use to be made of the slide hammer. If a stake is to be pounded into the ground, by raising the slide tube, but not sufficiently that the inner tube abuts against the anvil 12, and then slammed down the slide tube, the cap 10 transmits a hammering force to the anvil and through the mounting rod, extension and hammer plates 22, 23 respectively to the top edges **25*c* of the stake legs. This step is repeated until the post mount is, for example, about an inch or two above the ground. After the stake is driven into the ground, the pin 32 is removed, first removing the cotter member if used, and then the slide hammer extension is pulled out of the socket to leave the stake in the ground. Thence a post 30** that at its upper end mounts a sign (not shown), for example a real estate sign, is insert into the mount and set screws, not shown, threaded into the mount to abut against the post to firmly hold the post in place and advantageously in abutting relationship to the ground. As a result the top edges of the stake are not damaged such as would occur when using a sledge hammer, particularly when pounding the stake into frozen ground. Further the stake is driven straight down without someone holding the stake as frequently is the situation when using many convention methods. in part due to the axial length and the inner diameter of the pulling tube and the axial length of the socket having the extension extend thereinto.

When the stake is to be pulled, the hammer extension is again inserted into the stake member socket and secured therein by the pin 32. Thence the slide tube 11 is raised to impart a striking force by the inner tube to the underside of the anvil. This pulling force is transmitted through the pin 32 to the stake for pulling the stake out of the ground.

Even though the stake has been described as being right angular in transverse cross section (subtends an included angle of about 90°), it is to be understood that the stake may be of other cross section shapes such as C-shaped, tubular, have members portions intersecting at various angles, and etc., wherein the thickness of stake edge is many times smaller than the other transverse dimensions of the solid parts thereof, as long the extension and the socket defining member are modified to be of a transverse cross sectional shapes to be of a relatively close transverse fit of a nature with the different cross sectional stake when extending into the socket, and the hammer plates are modified to have their lower edge substantially form a mating fit with the upper transverse edges of the stake of the stake being used and being transversely as large as at least a major part of the area of the stake top terminal edge. With reference to the preceding sentence the thickness of the hammer plates (hammer member) may be greater than the thickness of the stake top edge while desirably the transverse shape of the stake and the hammer plates are generally the same and the width dimensions of the hammer plates desirably are at least about as great as the corresponding dimensions of the stake. It is desirable that the post mount extends arcuately through an angle greater than 180 degrees and of transverse dimensions such that when the post is extended thereinto the transverse movement of the post away from the stake is limited by abutting against the mount. With reference to the preceding sentence it is noted the illustrated post mount extends arcuately through an angle of 360 degrees.

Advantageously the lower edge of the hammer member is of a size and shape to abut against the entire top edge of the stake while the pin 32 in retaining the lower hammer member edge closely adjacent to the stake top edge also precludes a party extending a finger therebetween which could possibly result in injury during use of the slide hammer. In addition the pin 32 serves to retain the stake such that it is driven into the ground in a direction parallel to the direction of reciprocation of the slide member relative to the mounting member. That is the stake is driven straight into the ground without being manually held.

What is claimed is:

1. A slide hammer for driving a stake member into the ground, the stake member having a top edge, two legs having leg portions transversely extending at an angle relative to one another, and a side surface, the slide hammer comprising an axially elongated mounting member having a lower end portion that has a lower terminal transverse edge and a top end portion, an anvil mounted to the top end portion and having a top surface, a longitudinally elongated slide member longitudinally reciprocally mounted on the mounting member for upward and downward movement relative to the mounting member and having upper and lower end portions, a cap mounted by the slide member upper end portion for delivering a hammering blow to the anvil top surface when the slide member is moved downwardly relative to the mounting member, and a hammer member fixedly attached to the mounting member lower end portion and having a terminal transverse lower edge extending transversely away from the mounting member for abutting against the stake top edge to transmit a hammering force to the stake, the hammer member transverse lower edge being substantially more closely adjacent to the mounting member top end portion than the mounting member lower transverse edge while the mounting member lower end portion extends downwardly along the side surface of the stake, the hammer member having plate portions transversely extending at substantially the same angle relative to one another that the stake leg portions extend relative to one another.

2. A slide hammer according to claim 1 wherein the stake legs have upper end portions, the stake member includes a post mount that is adapted for mounting a post and is joined to the upper end portion of at least one of the legs, the post mount extending transversely through an angle of at least about 180 degrees for mounting a post, the post mount being shaped to act in cooperation with at least one of the stake legs to form a socket, the mounting member having means extending more remote from the cap than the hammer member and into the socket for substantially eliminating wobbling movement of the stake member relative to the mounting member.

3. A slide hammer according to claim 2 wherein the stake legs are longitudinally elongated and extend transversely at about right angles relative to one another and joined to one another to form an apex, the socket means defines a right angle closed space, the means extending more remote from the cap than the hammer member and into the socket in transverse cross section is of a right angle shape and of a size to extend into the socket and when extended thereinto, have free terminal vertical edges closely adjacent to the post mount and has an apex closely adjacent to the stake legs apex.

4. A slide hammer according to claim 3 wherein the stake top edge has a major portion, the hammer member has its lower transverse edge of a size to form a close fit with at least a major portion of the stake member top edge and there is provided means for connecting the stake member and mounting member to one another and removably retaining the mounting member and stake member in substantially fixed positions relative to one another with the hammer member lower edge at least very closely adjacent to the stake top edge.

5. A slide hammer according to claim 3 wherein the hammer member in transverse cross section is of a right angle shape and of a size to have its lower transverse edge form a mating fit with at least a major portion of the stake top edge.

6. A slide hammer according to claim 5 wherein the mounting member comprises a longitudinally elongated mounting rod having an upper end mounting the cap and a lower end portion, the mounting member means includes a right angle extension mounting the hammer member and having an apex portion fixedly joined to the lower end portion of the rod, the hammer member is joined to the extension to be exterior of the included right angle of the extension and the stake legs are exterior of the post mount.

7. A slide hammer for driving a stake member into the ground and pulling the stake member out of the ground wherein the stake member has a post mount for transversely surrounding at least a substantial portion of a post and a stake that has a terminal transverse top edge and a side surface and is joined to the post mount to in cooperation therewith form at least a partially closed socket that open upwardly, the slide hammer comprising a longitudinally elongated mounting member having a top end portion and a lower end portion that has a lower terminal transverse edge, an anvil mounted to the mounting member in fixed relationship thereto and having a top surface and a bottom surface, axially elongated slide member means axially reciprocally mounted on the mounting member for upward and downward movement relative thereto for delivering hammer blows to either one of the anvil upper and lower surface, and a hammer member fixedly attached to the mounting member lower end portion and having a transverse lower terminal edge extending transversely away from the mounting member and generally being of the same shape as the stake terminal top edge for abutting against the stake top edge to transmit a hammering force to the stake, the hammer member transverse lower edge being substantially more closely adjacent to the mounting member top end portion than the mounting member lower transverse edge, the mounting member lower end portion having a lower part more remote from the mounting member upper end portion than the hammer member for extending a substantial distance downwardly along the side surface of the stake when the hammer member lower edge abuts against the stake top terminal edge, the mounting member lower end portion being of a transverse cross section for extension into the socket in a relatively close fitting relationship thereto.

8. A slide hammer according to claim 7 wherein each of the stake terminal top transverse edge and the hammer member lower edge are transversely right angular and form a close fit with one another when the hammer member abuts against the stake terminal top edge, and there is provided means for removably retaining the stake member and at least one of the hammer member and the mounting member in substantially fixed relationship relative to one another with the hammer member and stake terminal top transverse edge closely adjacent one another when the mounting member extends within the socket.

9. A slide hammer according to claim 7 wherein the post mount is angular, the socket is exterior of the post mount, the mounting member upper end portion comprises a longitudinally elongated mounting rod and the lower end portion comprise a longitudinally elongated right angular extension having an upper part welded to the rod, the extension having the hammer member fixed thereto, and the stake edge and the hammer member lower edge being substantially transversely planar and the hammer member lower edge being of a size at least substantially as large as the stake terminal top'edge.

10. A slide hammer for driving a stake member into the ground, the stake member having a top edge and a side surface, the slide hammer comprising an axially elongated mounting member having a lower end portion that has a lower terminal transverse edge and a top end portion, an anvil mounted to the top end portion and having a top surface, a longitudinally elongated slide member longitudinally reciprocally mounted on the mounting member for upward and downward movement relative to the mounting member and having upper and lower end portions, a cap mounted by the slide member upper end portion for delivering a hammering blow to the anvil top surface when the slide member is moved downwardly relative to the mounting member, and a hammer member fixedly attached to the mounting member lower end portion and having a terminal transverse lower edge extending transversely away from the mounting member for abutting against the stake member top edge to transmit a hammering force to the stake member, the hammer member transverse lower edge being substantially more closely adjacent to the mounting member top end portion than the mounting member lower transverse edge while the mounting member lower end portion extends downwardly along the side surface of the stake member.

11. A slide hammer according to claim 10 wherein the hammer member lower transverse edge that is abuttable against the stake member top edge is of a thickness many times smaller that the width dimension of the mounting member transverse edge.

12. A slide hammer according to claim 10 wherein there is provided means for removably attaching at least one of the hammer member and mounting member to the stake member to retain the mounting member in substantially fixed relationship to the stake while the cap delivers a hammering blow to the anvil.

13. A slide hammer according to claim 12 wherein the anvil has a bottom surface, the slide member has means for striking the anvil bottom surface when the slide member is moved away from the stake member while at least one of the hammer member and mounting member is attached to the stake member.

* * * * *